US011395079B2

(12) United States Patent
Liu

(10) Patent No.: US 11,395,079 B2
(45) Date of Patent: Jul. 19, 2022

(54) METHOD AND DEVICE FOR DETECTING AUDIO INPUT MODULE, AND STORAGE MEDIUM

(71) Applicant: Beijing Xiaomi Pinecone Electronics Co., Ltd., Beijing (CN)

(72) Inventor: Jingang Liu, Beijing (CN)

(73) Assignee: Beijing Xiaomi Pinecone Electronics Co., Ltd., Beijing (CN)

( * ) Notice: Subject to any disclaimer, the term of this patent is extended or adjusted under 35 U.S.C. 154(b) by 0 days.

(21) Appl. No.: 17/026,278

(22) Filed: Sep. 20, 2020

(65) Prior Publication Data

US 2021/0337331 A1 Oct. 28, 2021

(30) Foreign Application Priority Data

Apr. 28, 2020 (CN) ..... 202010349063.3

(51) Int. Cl.
*H04R 29/00* (2006.01)
*G10L 25/51* (2013.01)

(52) U.S. Cl.
CPC ..... *H04R 29/00* (2013.01); *G10L 25/51* (2013.01)

(58) Field of Classification Search
CPC .... H04R 29/00; H04R 3/005; H04R 2420/07; H04R 1/406; H04R 5/04; H04R 3/04; H04R 3/12; H04R 27/00; H04R 2499/11; H04R 3/00; H04R 3/02; H04R 1/028; H04R 1/1041; H04R 2410/01; H04R 2201/401; H04R 29/005; H04R 5/033; H04R 1/08; H04R 1/1083; H04R 2201/403; H04R 2201/405; H04R 2227/003; H04R 2410/05; H04R 2420/09; H04R 2430/01;
(Continued)

(56) References Cited

U.S. PATENT DOCUMENTS 6,687,373 B1 * 2/2004 Yeh ..... H04B 3/23 370/290
8,345,860 B1 1/2013 Kumar
(Continued)

FOREIGN PATENT DOCUMENTS

CN 104885438 A 9/2015
CN 105554202 A 5/2016
(Continued)

OTHER PUBLICATIONS

Supplementary European Search Report in the European application No. 20199530.5, dated Mar. 26, 2021.
(Continued)

*Primary Examiner* — Akelaw Teshale
(74) *Attorney, Agent, or Firm* — Syncoda LLC; Feng Ma

(57) ABSTRACT

A method for detecting an audio input includes: acquiring audio input signals received by at least two input signal channels of an audio input module; for each of the audio input signals, filtering the audio input signal according to a preset audio output signal of an electronic device where the audio input module is located to obtain a target signal; for each of the audio input signals, determining a comparison parameter value according to the target signal and the audio input signal; and determining a performance state of the audio input module according to the comparison parameter values.

18 Claims, 8 Drawing Sheets

(58) Field of Classification Search
CPC ..... H04R 2430/20; H04R 2460/01; H04R 2460/07; H04R 2499/13; H04R 2499/15; H04R 5/02; H04R 5/027; H04R 19/04; H04R 1/10; H04R 1/245; H04R 2201/028; H04R 2201/107; H04R 2205/024; H04R 2225/43; H04R 2420/01; H04R 2430/23; H04R 25/453; H04R 25/505; H04R 5/0335; H04R 19/005; H04R 1/04; H04R 1/1008; H04R 1/1016; H04R 1/2876; H04R 1/326; H04R 1/403; H04R 2201/003; H04R 2201/40; H04R 2203/12; H04R 2225/39; H04R 2225/41; H04R 2225/55; H04R 2227/005; H04R 2227/009; H04R 2410/07; H04R 2430/03; H04R 2430/21; H04R 2499/10; H04R 25/405; H04R 25/401; H04R 25/43; H04R 25/558; H04R 25/70; H04R 29/004; H04R 29/006; G10L 25/51
See application file for complete search history.

(56) References Cited

U.S. PATENT DOCUMENTS

| | | | | |
|---|---|---|---|---|
| 11,064,294 | B1 * | 7/2021 | Masnadi-Shirazi | H04R 1/406 |
| 11,069,364 | B1 * | 7/2021 | Souza | H04R 5/04 |
| 2008/0140395 | A1 * | 6/2008 | Yeldener | G10L 21/0208 704/226 |
| 2009/0296946 | A1 * | 12/2009 | Zhang | H04R 29/005 381/58 |
| 2015/0078571 | A1 * | 3/2015 | Kurylo | H04M 3/568 381/71.8 |
| 2016/0219386 | A1 | 7/2016 | Krishnaswamy et al. | |
| 2018/0261232 | A1 * | 9/2018 | Chebiyyam | H04R 3/005 |
| 2019/0149916 | A1 * | 5/2019 | Takayama | H04R 3/005 381/26 |
| 2020/0351584 | A1 * | 11/2020 | Zhou | G10L 21/0208 |

FOREIGN PATENT DOCUMENTS

| | | | | | |
|---|---|---|---|---|---|
| CN | 105979053 | A | | 9/2016 | |
| CN | 108562839 | A | | 9/2018 | |
| CN | 108932949 | A | | 12/2018 | |
| CN | 109005272 | A | | 12/2018 | |
| CN | 109286730 | A | | 1/2019 | |
| CN | 110677780 | A | | 1/2020 | |
| CN | 110691314 | A | * | 1/2020 | H04R 29/001 |
| CN | 110691314 | A | | 1/2020 | |
| CN | 111031463 | A | | 4/2020 | |
| JP | 2002135172 | A | * | 5/2002 | |
| WO | WO-2012176932 | A1 | * | 12/2012 | G10L 25/78 |

OTHER PUBLICATIONS

First Office Action of the Chinese application No. 202010349063.3, dated Jan. 25, 2021.
Second Office Action of the Chinese application No. 202010349063.3, dated Jun. 30, 2021.
Notice of Allowance of the Chinese application No. 202010349063.3, dated Mar. 30, 2022.

* cited by examiner

METHOD AND DEVICE FOR DETECTING AUDIO INPUT MODULE, AND STORAGE MEDIUM

CROSS-REFERENCE TO RELATED APPLICATIONS

This application claims priority to Chinese Patent Application No. 202010349063.3 filed on Apr. 28, 2020, the disclosure of which is hereby incorporated by reference in its entirety.

BACKGROUND

Voice interaction is one of the important human-computer interaction methods that have gradually developed in electronic devices in recent years. Audio input modules such as smart microphones and voice assistants have gradually been widely used. Some audio input modules have a microphone array composed of multiple microphones, which can achieve a more accurate and clear sound reception effect, and process audio signals received by each channel of the microphone array through a sound pickup algorithm.

SUMMARY

The present disclosure relates generally to electronic technologies, and more specifically to a method and device for detecting an audio input module, and a storage medium.

According to a first aspect of an embodiment of the present disclosure, a method for detecting an audio input module is provided. The method includes operations as follows.

Audio input signals received by at least two input signal channels of the audio input module are acquired.

For each of the audio input signals, the audio input signal is filtered according to a preset audio output signal of an electronic device where the audio input module is located, to obtain a target signal;

For each of the audio input signals, a comparison parameter value is determined according to the target signal and the audio input signal.

A performance state of the audio input module is determined according to the comparison parameter values.

According to a second aspect of the embodiments of the present disclosure, a device for detecting an audio input module is provided, which includes a processor and a memory for storing executable instructions runnable on the processor.

The processor is configured to run the executable instructions to: acquire audio input signals received by at least two input signal channels of the audio input module; for each of the audio input signals, filter the audio input signal according to a preset audio output signal of an electronic device where the audio input module is located, to obtain a target signal; for each of the audio input signals, determine a comparison parameter value according to the target signal and the audio input signal; and determine a performance state of the audio input module according to the comparison parameter values.

According to a third aspect of the embodiments of the present disclosure, a non-transitory computer-readable storage medium having stored thereon computer executable instructions is provided. The computer-executable instructions, when being executed by a processor, implement the operations in any one method for detecting an audio input module described above.

It should be understood that the above general descriptions and detailed descriptions below are only exemplary and explanatory and not intended to limit the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Figure 1:
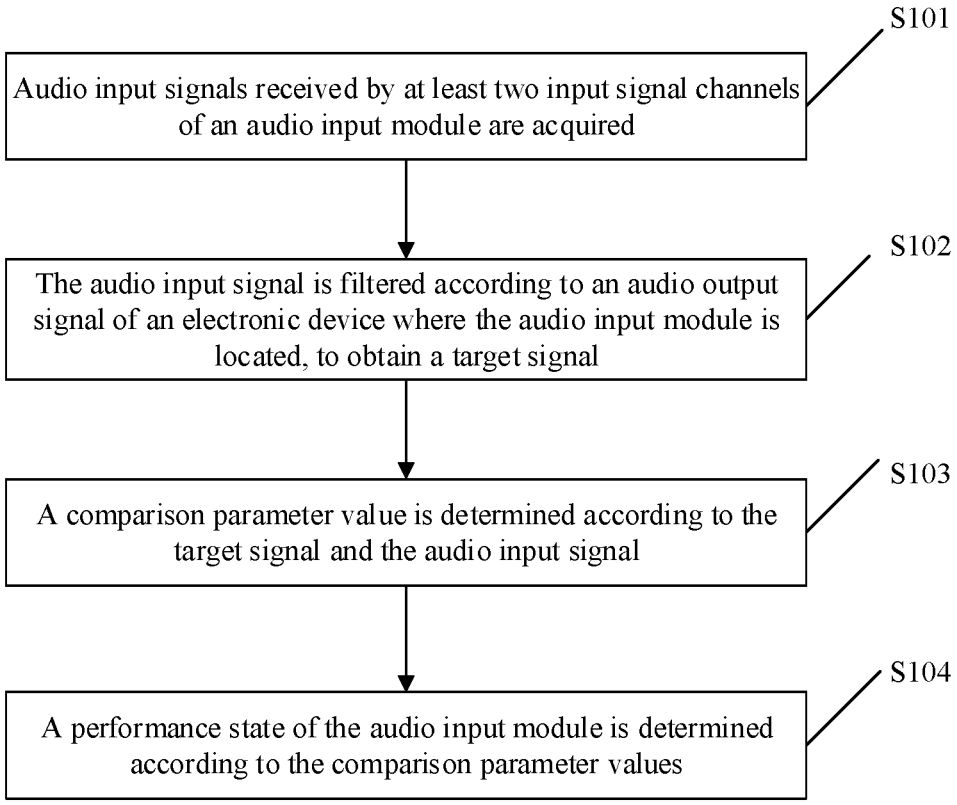
FIG. 1 is a first flowchart of a method for detecting an audio input module according to some embodiments of the present disclosure.

Exemplary embodiments (examples of which are illustrated in the accompanying drawings) are elaborated below. The following description refers to the accompanying drawings, in which identical or similar elements in two drawings are denoted by identical reference numerals unless indicated otherwise. The exemplary implementation modes may take on multiple forms, and should not be taken as being limited to examples illustrated herein. Instead, by providing such implementation modes, embodiments herein may become more comprehensive and complete, and comprehensive concept of the exemplary implementation modes may be delivered to those skilled in the art. Implementations set forth in the following exemplary embodiments do not represent all implementations in accordance with the subject disclosure. Rather, they are merely examples of the apparatus and method in accordance with certain aspects herein as recited in the accompanying claims.

In some situations, audio input modules may be damaged due to environmental impact, aging or other reasons, which can cause invalidate sound pickup algorithm, and failure to wake up a device normally through voice. Some embodiments of the present disclosure can provide more robust audio input modules and more robust sound pickup methods.

FIG. 1 is a flowchart of a method for detecting an audio input module according to some embodiments of the present disclosure. As shown in FIG. 1, the method may be applied to an electronic device having an audio input module and an audio output module, and includes the following operations.

At S101, audio input signals received by at least two input signal channels of the audio input module are acquired.

At S102, each of the audio input signals is filtered according to a preset audio output signal of an electronic device where the audio input module is located, to obtain a target signal.

At S103, a comparison parameter value is determined according to the target signal and the audio input signal.

At step S104, a performance state of the audio input module is determined according to the comparison parameter value.

Various embodiments of the present disclosure can have one or more of the following advantages. According to the technical solutions of the embodiments of the present disclosure, a comparison parameter value determined in the process of filtering out an audio output signal from an audio signal is used to determine whether an input signal channel can filter out the audio output signal normally, and further a performance state of an audio input module is determined. With the method, an abnormal input signal channel can be screened out, for adjusting a data processing algorithm of the audio input module for each input signal channel, thereby obtaining high accuracy and robustness, and wide application range.

The audio input module in some embodiments of the present disclosure refers to a sound pickup device, for example, a microphone, having multiple input signal channels for receiving audio signals. Each input signal channel can independently receive various audio signals with different frequencies and different strengths in the surrounding environment, and convert the audio input signals into electrical signals. For example, a microphone array, composed of a certain number of acoustic sensors, can sample and process the spatial characteristics of a sound field. The audio signal received by each input signal channel of the audio input module is processed by a sound pickup algorithm. When the audio signals are collected by the input signal channels in different orientations at the same time, spatial information of sound can be obtained, which can be used for a scenario such as sound source positioning.

The audio input module may be installed on an electronic device, and the electronic device also has an audio output module, such as various multimedia devices such as a smart speaker, a mobile phone, and a smart TV. While the audio input module receives external audio input signals, a preset audio output module of the electronic device may also emit sound. For example, during the call of a mobile phone, if a hands-free function is turned on, the mobile phone plays voice transmitted by a user in addition to receiving the voice from the user. For another example, the smart speaker may receive a voice instruction from the user through the audio input module while playing music.

Based on the above-mentioned application scenario of the electronic device, the problem of echo may occur. That is, while the audio input module receives sound, i.e., an echo, played by the electronic device while receiving the external audio input signals such as voice instructions. However, since the electronic device may estimate the echo received by the audio input module according to the played sound, the electronic device may remove the echo part by a filtering mode, and only reserve the external audio input signal.

In some embodiments of the present disclosure, a performance state of the audio input module is determined using the process of removing the echo by filtering of the electronic device. If there is an abnormal channel in the audio input module, the channel cannot receive an audio signal normally, and cannot receive an audio output signal of the electronic device normally. Therefore, when the audio input signal is filtered, the echo part cannot be filtered out normally and there is no big difference between the target signal obtained by the filtering and the audio input signal. Therefore, according to the comparison parameter value used for indicating the difference between the target signal and the audio input signal, whether a corresponding input signal channel is abnormal is determined and further a performance state of the audio input module is determined.

The above comparison parameter value may be expressed by a ratio, a difference, a square difference or the like of frequencies of the target signal and the audio input signal. According to the performance requirements of the audio input module, a threshold range may also be set for the above comparison parameter value. If the comparison parameter value is within a threshold range, it is considered that the input signal channel corresponding to the comparison parameter value can receive audio signals normally. If the comparison parameter value exceeds the threshold range, the input signal channel corresponding to the comparison parameter value is considered to be an abnormal channel.

After confirming whether each input signal channel of the audio input module is abnormal, a sound pickup algorithm may be adjusted adaptively, the normal input signal channel is used as an operation channel, and the abnormal channel is closed, thereby improving the accuracy of the sound pickup algorithm, and further improving the overall robustness of the audio input module.

In some embodiments, the operation that the audio input signal is filtered according to the audio output signal outputted by an electronic device where the audio input module is located to obtain a target signal includes an operation as follows.

A signal component, corresponding to the audio output signal, in the audio input signal is filtered out to obtain the target signal.

Since the preset audio output signal of the electronic device may change at different times, the audio output signal is received in real time for the audio input module. Therefore, the audio input signal is required to be filtered in real time as the electronic device outputs the audio output signal. The audio input signal contains external input signals, such as a voice instruction of a user, and also contains the echo part of the audio output signal.

The above echo part is the corresponding signal component in the audio input signal, which needs to be removed by filtering. The echo part may include two types. One type of echo part is a signal component that is an audio output signal which is sent from the electronic device and directly enters into the audio input module without any reflection, and the signal component is almost synchronized with the time when the audio output signal is sent. The other type of echo part is a signal component that is the audio output signal which returns to the audio input module after being sent from the electronic device and reflected by the external environment, and the signal component may have a time difference with the time of sending the audio output signal.

Therefore, in some embodiments of the present disclosure, the signal components corresponding to the audio output signal in the two cases can also be considered, to perform more accurate filtering and obtain the target signal.

In some embodiments, the operation that a performance state of the audio input module is determined according to the comparison parameter value includes operations as follows.

In response to that the comparison parameter value is greater than a preset parameter threshold, it is determined that the input signal channel corresponding to the audio input signal is a normal channel.

In response to that the comparison parameter value is less than or equal to the preset parameter threshold, it is determined that the input signal channel corresponding to the audio input signal is a first abnormal channel.

In some embodiments of the present disclosure, the threshold range of the comparison parameter value may be preset according to the performance requirements of the audio input module. Here, the preset parameter threshold is used as a criterion for determining whether the input signal channel is abnormal. If the comparison parameter value is greater than the preset parameter threshold, it indicates that the target signal obtained after filtering is significantly different from the audio input signal before filtering, that is, the echo signal component corresponding to the audio output signal is filtered out. If the comparison parameter value is less than or equal to the preset parameter threshold, it indicates that the difference between the target signal and the audio input signal is small, and the echo signal component corresponding to the audio output signal is not successfully filtered. That is to say, the input signal channel may be abnormal, and the echo signal component corresponding to the output audio input module cannot be received, or the received echo signal component is weak.

In this way, whether each input signal channel of the audio input module is abnormal is screened through the comparison parameter value obtained by filtering, to adjust the sound pickup algorithm in real time.

In some embodiments, the method further includes an operation that if the first abnormal channel exists, the first abnormal channel is disabled.

Here, the manner of adjusting the sound pickup algorithm may be to disable at least several input signal channels including the first abnormal channel. The disabling here may be closing these channels in hardware and disconnecting a signal path, and may also be disabling signals of these channels in the algorithm. In addition, only the first abnormal channel may be disabled while continuing using other channels or the first abnormal channel is disabled while disabling several other channels.

For example, if there are 12 microphone channels, one of which is the first abnormal channel, the sound pickup algorithm may be adjusted to a 9-channel algorithm, and three channels containing the first abnormal channel at the same interval may be disabled, to maintain the sound pickup effect while facilitating algorithm processing. In practical applications, which channels are to be disabled is determined according to the actual number and distribution of input signal channels. In some embodiments, the comparison parameter value includes: an attenuation factor and/or an echo return loss enhancement (ERLE).

The attenuation factor includes a ratio of the audio input signal to the target signal.

The ERLE includes a logarithmic value of a square ratio of the audio input signal to the target signal.

Here, the comparison parameter value is calculated based on the target signal obtained after filtering and the original audio input signal received by the input signal channel, which can reflect a difference between the signals before and after filtering, and further reflect the filtering effect. If the filtering effect is poor, there may be an abnormality in the input signal channel.

In some embodiments of the present disclosure, the above attenuation factor or ERLE may be used to represent the comparison parameter value. The attenuation factor includes a ratio of an audio input signal r(n) to a target signal e(n).

If the ratio of the audio input signal r(n) to the target signal e(n) is much greater than 1, it indicates that the target signal e(n) is significantly different from the audio input signal r(n), and the filtering process effectively removes an echo signal component in the audio input signal. If the ratio of the audio input signal r(n) to the target signal e(n) is small, for example, the ratio is about 1, it indicates that the difference between the audio input signal r(n) and the target signal e(n) is small, and the filtering process has no effect on the audio input signal. Therefore, it can be determined that the corresponding input signal channel is abnormal.

The ERLE includes a logarithmic value of a square ratio of the audio input signal r(n) to the target signal e(n), and is expressed as formula (1):

$$ERLE = 10\text{Log}\,\frac{E[r^2(n)]}{E[e^2(n)]}db \tag{1}$$

E represents an expected value of a frame of signal or a segment of signal, and n represents a frame number of the signal. A logarithm mode is used to convert signal data into decibel values (db), for facilitating data calculation and processing. Similar to the attenuation factor, the ERLE may also reflect the difference of the signals before and after the filtering. The filtering effect is better as the value of the ERLE is larger, and the filtering effect is worse as the value is smaller. Therefore, when the ERLE is less than a preset threshold, it can be determined that the corresponding input signal channel is abnormal.

Figure 2:
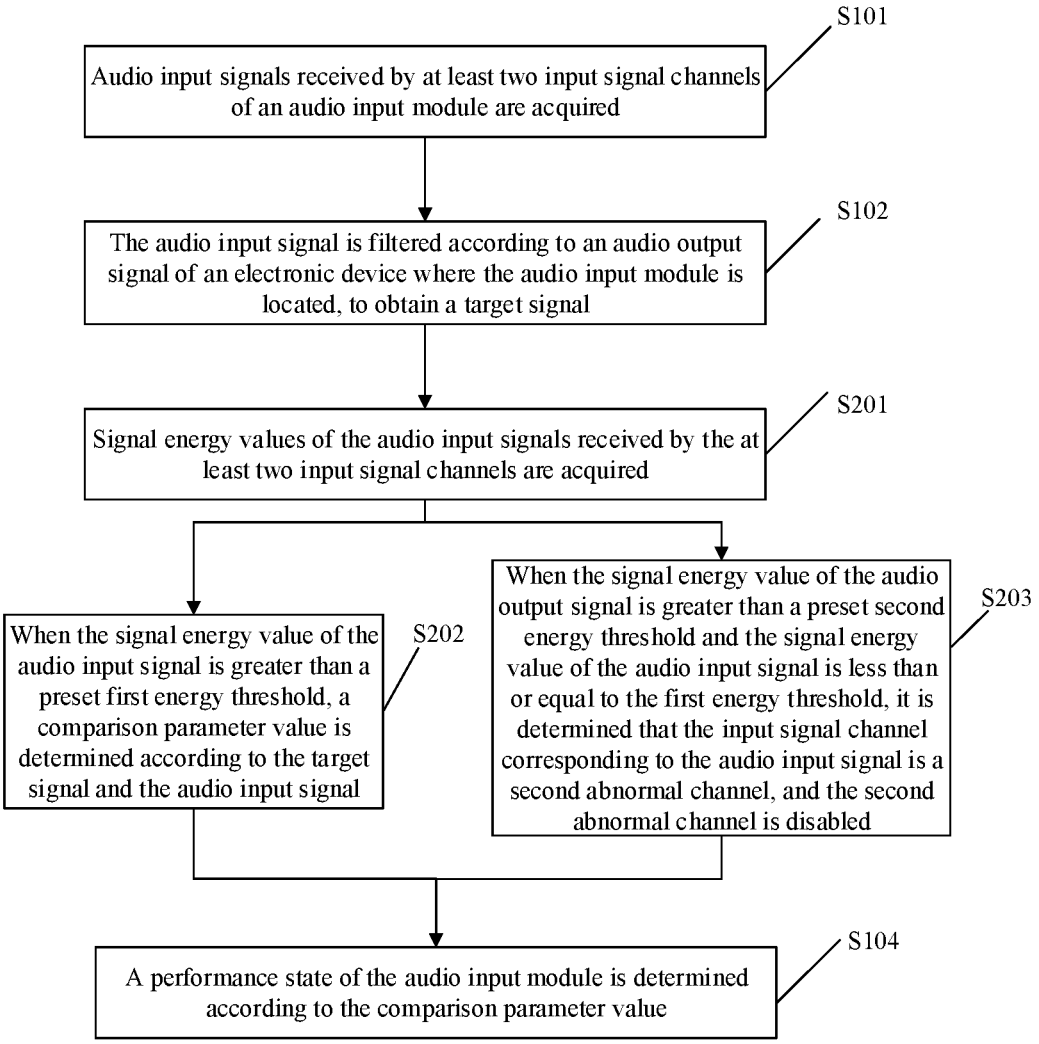
FIG. 2 is a second flowchart of a method for detecting an audio input module according to some embodiments of the present disclosure.

In some embodiments, as shown in FIG. 2, the method further includes the following operations.

At S201, a signal energy value of each of the audio input signals received by the at least two input signal channels is acquired.

The operation S103 that a comparison parameter value is determined according to the target signal and the audio input signal includes the following operation.

At S202, when the signal energy value of the audio input signal is greater than a preset first energy threshold, the comparison parameter value is determined according to the target signal and the audio input signal.

In some embodiments of the present disclosure, while the audio output signal exists in the electronic device, the audio input signal is filtered to remove the echo signal component. In this process, the performance of the input signal channel is obtained by monitoring the filtering effect. In other words, if the electronic device does not have an audio output signal, the performance of the input signal channel cannot be detected by the above method.

Therefore, the signal energy value of the audio input signal may be used to determine whether the corresponding input signal channel receives the audio signal. If the signal energy value is too low, that is, less than a preset first energy threshold, there may be caused in two cases. The first case is that the electronic device does not output an audio output signal, and the second case is that the input signal channel is abnormal and cannot receive audio signals.

If it is the first case, the performance of the input signal channel cannot be detected by the above method of the embodiment of the present disclosure. If it is the second case, a result that the input signal channel is abnormal is obtained after the method of the embodiment of the present disclosure is used for detecting. Therefore, detection is not required.

Therefore, in some embodiments of the present disclosure, the detection may be performed only when the signal energy value is greater than the preset first energy threshold. In this way, if the input signal channel is abnormal and cannot receive the audio signal normally, and there may be excessive noise, etc., whether the input signal channel is normal is detected accurately by the method of monitoring the comparison parameter value obtained by filtering in some embodiments of the present disclosure. In this way, not only the accuracy of detection can be improved, but also the detection efficiency can be improved and unnecessary detection can be reduced.

In some embodiments, the method further includes the following operations.

At S203, when the signal energy value of the audio output signal is greater than a preset second energy threshold and the signal energy value of the audio input signal is less than or equal to the first energy threshold, it is determined that the input signal channel corresponding to the audio input signal is a second abnormal channel, and the second abnormal channel is disabled.

In some embodiments of the present disclosure, if the above energy detection method determines that the audio input signal received by the input signal channel has low energy, and the electronic device determines that there is an audio output signal, that is, the electronic device determines that the signal energy value of the audio output signal is greater than a second energy threshold, and the energy of the audio input signal is less than or equal to the first energy threshold, it indicates that the input signal channel fails to receive the audio output signal normally. Therefore, in this case, it may also be determined that the input signal channel of the audio input module is abnormal.

Here, the first energy threshold is a signal energy threshold of the audio input signal, and the second energy threshold is a signal energy threshold of the audio output signal. Since the audio output signal is outputted and then transmitted to the audio input module, the audio output signal may have certain attenuation. Therefore, the first energy threshold may be slightly smaller than the second energy threshold. In addition, the first energy threshold may also be dynamically set according to the signal energy value of the audio output signal. For example, the second energy threshold is 0, that is, as long as the audio output signal exists, it is satisfied that energy of the audio output signal is greater than the second energy threshold. If the signal energy value of the audio output signal is 100, the first energy threshold may be determined to be 80 correspondingly. If the signal energy of the audio output signal is reduced to be 10, the first energy threshold is adjusted to be 8 correspondingly.

In another embodiment, when the signal energy value of the audio output signal is less than or equal to a preset second energy threshold, the detection is suspended.

If the electronic device determines that the signal energy value of the audio output signal is small, or there is no audio output signal, it is unable to determine whether the input signal channel is abnormal through the comparison parameter value obtained by filtering. Therefore, the detection may be suspended. The detection may be restarted when the electronic device starts outputting an audio output signal.

Figure 3:
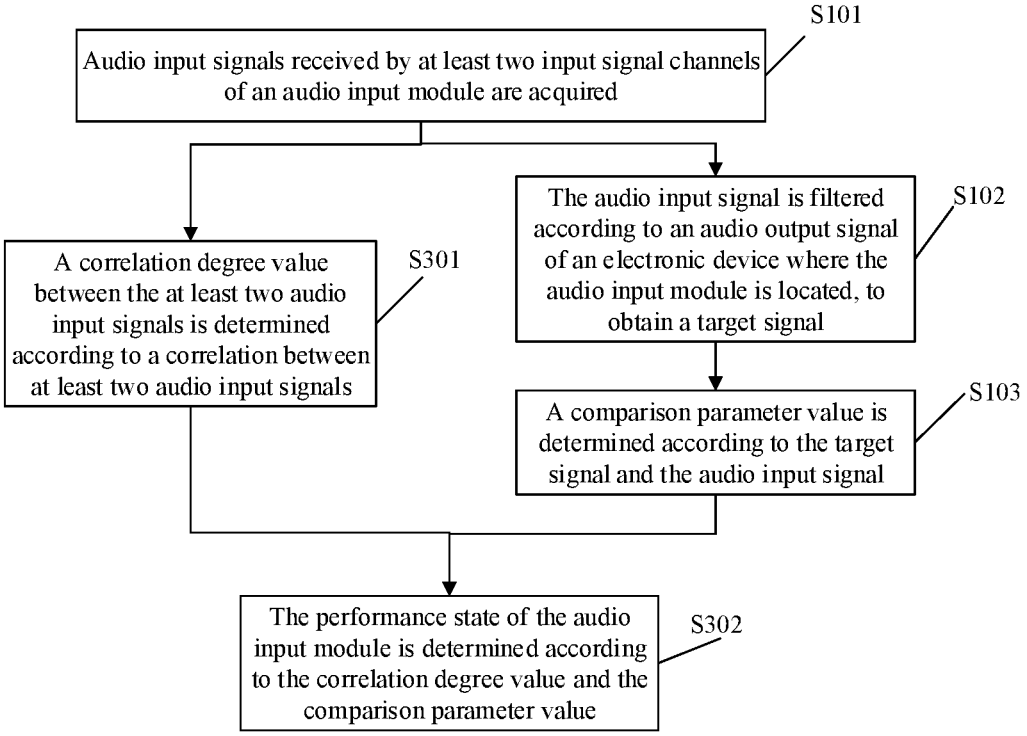
FIG. 3 is a third flowchart of a method for detecting an audio input module according to some embodiments of the present disclosure.

In some embodiments, as shown in FIG. 3, the method further includes operations.

At S301, a correlation degree value between the at least two audio input signals is determined according to a correlation between at least two audio input signals.

The operation S104 that a performance state of the audio input module is determined according to the comparison parameter value, including the following operation.

At S302, the performance state of the audio input module is determined according to the correlation degree value and the comparison parameter value.

In some embodiments of the present disclosure, the method for determining whether the input signal channel is abnormal based on the comparison parameter value obtained by filtering has high accuracy, however, the method may take a long time or the method is used for detection only when the electronic device has an audio output signal.

Therefore, the completeness of detection for the audio input module detection of the electronic device is improved in conjunction with correlation detection between audio input signals. For example, correlation detection can be performed when the electronic device is turned on, to obtain a detection result quickly. In some embodiments, during the operation of the electronic device, correlation detection can be performed at intervals to screen an abnormal input signal channel. When the electronic device has an audio output signal, the performance of each input signal channel is further determined by the above comparison parameter value.

In some embodiments of the present disclosure, the correlation detection requires audio input signals received by at least two input signal channels, and whether each input signal channel is normal is determined by calculating correlation between every two of at least two audio input signals. Since all input signal channels of the audio input module are arranged in the same environment, the normal input signal channels can receive basically-identical audio input signals. The positions of different input signal channels are different, that is, there should also be a slight time difference or intensity difference between the received audio input signals.

A correlation degree value between the audio input signals received by the normal input signal channels is high, but the audio input signals are not completely identical. Therefore, whether each input signal channel is abnormal can be determined quickly based on whether the correlation degree value meets a range of a correlation threshold.

Figure 4:
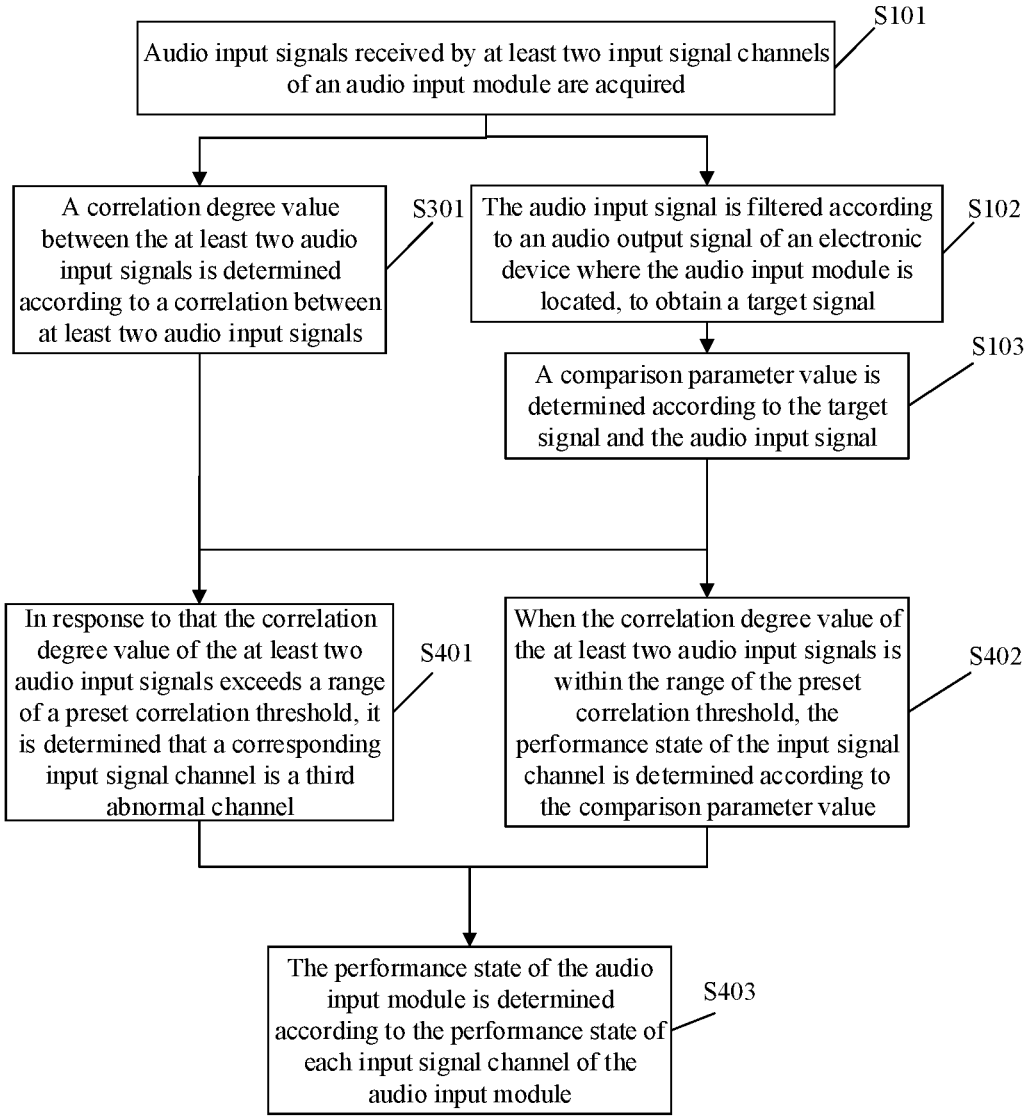
FIG. 4 is a fourth flowchart of a method for detecting an audio input module according to some embodiments of the present disclosure.

In some embodiments, as shown in FIG. 4, the operation S302 that a performance state of the audio input module is determined according to the correlation degree value and the comparison parameter value includes operations as follows.

At S401, in response to that the correlation degree value of the at least two audio input signals exceeds a range of a preset correlation threshold, the corresponding input signal channel is determined as a third abnormal channel.

At S402, in response to that the correlation degree value of the at least two audio input signals is within the range of the preset correlation threshold, a performance state of the input signal channel is determined according to the comparison parameter value.

At S403, a performance state of the audio input module is determined according to the performance states of all the input signal channels of the audio input module.

If the correlation detection method is used to determine that the correlation degree value between every two of at least two audio input signals exceeds the range of the above preset correlation threshold, it indicates that the corresponding signal channel cannot receive the audio signal normally, and thus the signal channel can be determined as an abnormal channel. In addition, if the two audio input signals are completely identical, the two signal channels may also be abnormal due to a short circuit in wiring of the two signal channels or the like, that is, the two audio input signals have a strong correlation. Therefore, if the correlation degree value is too large, for example, the correlation degree value is 1 (a value range of the correlation degree value is between 0 and 1), the two input signal channels may be determined as abnormal channels.

If a result that the input signal channel is normal is obtained through the above correlation detection mode, a performance state of the input signal channel may be further determined through the parameter comparison value.

After the performance state of each input signal channel is detected in the above manner, an overall performance state of the audio input module may be further determined, and the sound pickup algorithm may be adjusted.

In some embodiments, the method further includes the following operations.

If the third abnormal channel exists, the third abnormal channel is disabled.

If it is determined that the input signal channel is the third abnormal channel through the above correlation detection, the sound pickup algorithm may be adjusted by disabling the third abnormal channel. It should be noted that, in order to ensure the sound pickup effect of the audio input module, several normal channels corresponding to the third abnormal channel may also be disabled while the third abnormal channel is disabled, so as to facilitate processing for the audio input signal by the pickup algorithm. For example, if there are 12 microphone channels, one of which is the third abnormal channel, the pickup algorithm may be adjusted to a 9-channel algorithm, and the three channels containing the third abnormal channel at the same interval may be disabled to maintain the sound pickup effect while facilitating algorithm processing.

If in the subsequent operation process of the electronic device, it is detected and determined through the method in the above embodiment that there is also the first abnormal channel or the second abnormal channel, the channel corresponding to the first abnormal channel or the second abnormal channel may be further disabled on the basis of the current algorithm. For example, in the above example, there are 12 microphone channels, and only 9 channels are enabled due to the presence of the third abnormal channel. If the 9 channels include one first abnormal channel, three channels including the first abnormal channel may be disabled, and the sound pickup algorithm is adjusted to a 6-channel algorithm. In practical applications, how to adjust the sound pickup algorithm may be determined according to the actual number and distribution of microphone channels, and some microphone channels including the first abnormal channel are disabled.

In some embodiments, the operation that a correlation degree value between the at least two audio input signals is determined according to a correlation between at least two audio input signals includes the following operations.

A correlation degree value between the at least two audio input signals is determined within a predetermined time by a first detection mode; and/or a sub-correlation degree value is determined according to multiple segments of audio input signals in the at least two input signal channels by a second detection mode, and the correlation degree value is determined according to a weighted sum of the sub-correlation degree values.

In some embodiments of the present disclosure, the correlation detection may include the above two detection modes. The first detection mode is quick detection, which can be used within a period of time when the audio input module is powered on. That is, the audio input module may be detected as soon as it is powered on, and a detection result may be quickly obtained within a predetermined time to determine an initial sound pickup algorithm.

The second detection mode is slow detection, in which detection may be performed at intervals in a case that that the audio input module is turned on. Multiple audio input signals, that is, audio input signals in multiple time periods are collected in each detection, correlation detection is performed on the audio input signals, and a final correlation degree value is obtained by weighing. Compared with quick detection, the slow detection can obtain more accurate results, but requires a longer detection time. Therefore, when the audio input module is turned on, the slow detection may be used as a basis for adjusting the sound pickup algorithm of the audio processing module.

The above two correlation detection methods are based on the correlation between different input signal channels, and when the external environment of the device is complicated, false detection also occurs. Therefore, in some embodiments of the present disclosure, when the audio input module is turned on and the audio input module has an audio output signal, the input signal channel is detected based on the above comparison parameter value of the signal, to improve the accuracy of detection, and making the performance of the audio input module more robust.

In some embodiments, the operation that whether the input signal channels corresponding to the at least two audio input signals are a third abnormal channel is determined according to the correlation degree value includes operations as follows.

In response to that the first detection mode is adopted, whether the input signal channels corresponding to the at least two audio input signals are a third abnormal channel is determined according to whether the correlation degree value is within a first correlation threshold range.

In response to that the second detection mode is adopted, whether the input signal channels corresponding to the at least two audio input signals are a third abnormal channel is determined according to whether the correlation degree value is within a second correlation threshold range.

The second correlation threshold range is located within the first correlation threshold range.

Here, the first correlation threshold range of the first detection mode, that is, the above quick detection, is larger than the second correlation threshold range of the second detection mode, that is, the above slow detection. Since a detection speed of the quick detection is quick, and the detection is performed as soon as the audio input module is powered on, the quick detection has low accuracy, and is only used to quickly screen out the seriously damaged input signal channels. Therefore, a large first correlation threshold range may be set.

The second detection mode requires more accurate detection results, and the detection time is not limited. Therefore, a small second correlation threshold range may be set.

Through the above technical solutions of the embodiment of the present disclosure, the detection method which is combined with the correlation detection and refers to the audio output signal can improve accuracy and timeliness of detection for the audio input module, and further improve robustness of the audio input module.

In order to facilitate understanding of the technical solutions of the embodiment of the present disclosure, the present disclosure also provides the following examples.

In order to improve robustness of a microphone array, a method for detecting a microphone is provided here. After the sound is picked up, a state of each microphone in the microphone array is detected, and an abnormal microphone is eliminated. The method may be applied to a device with multiple microphones for sound pickup. An abnormal microphone is found through a set detection and determination mechanism, and then a degraded microphone array algorithm is used for non-abnormal microphones. For example, a six-microphone device may use a four-microphone algorithm or a two-microphone algorithm after the fault microphone is found. The detection and determination mechanism here may use a parameter such as a correlation between the microphones, and check the convergence of sound signals in an echo scene, so as to determine the state of the microphone.

Figure 5:
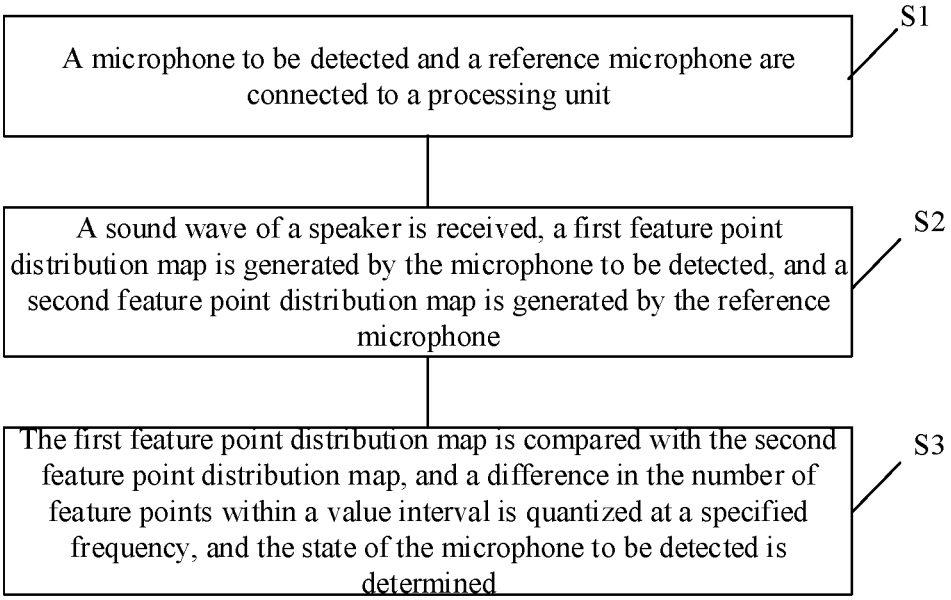
FIG. 5 is a fifth flowchart of a method for detecting an audio input module according to some embodiments of the present disclosure.

Generally, the method shown in FIG. 5 is used for microphone detection, including the following operations.

At S1, a microphone to be detected and a reference microphone are connected to a processing unit.

At S2, a sound wave of a speaker is received, a first feature point distribution map is generated by the microphone to be detected, and a second feature point distribution map is generated by the reference microphone.

At S3, the first feature point distribution map and the second feature point distribution map are compared, and a difference in the number of feature points within a value interval is quantized at a specified frequency, to determine a state of the microphone to be detected.

The above feature point distribution map is obtained by sampling the waveform of the sound signal, and a collected sound wave signal may be roughly observed according to the feature point distribution map. The feature point distribution maps generated by the microphone to be detected and the reference microphone respectively are compared, that is, whether there is a big difference in the signal waveforms received by the two microphones is observed. If there is a big difference, it is considered that the microphone to be detected is abnormal.

The above waveform diagram may be a relationship of a change of sound intensity with time, or a relationship of a change of a signal energy value at a specific frequency with time, and the like. Therefore, the above feature points at least include a signal capability value at a specific frequency.

For the above method of detecting single frequency points in relative to reference microphones, relevant detection can be performed only at the factory. Therefore, when a fault occurs during usage of the user, an adjustment algorithm cannot be corrected in time. Since only a single frequency point is detected, it cannot be ensured that all frequency bands are normal. In addition, only the difference between numerical feature points is parsed and the state of the microphone cannot be accurately feedback in this method.

In order to enable the user to quickly learn the state of the microphone as soon as the electronic device is powered on, a quick detection can be performed when the electronic device is powered on. However, since short-term characteristics of the microphone are susceptible to various environmental factors, a mode of combining quick detection and slow detection is proposed here. When the electronic device is started, the electronic device is detected within a prescribed time period to obtain a quick test result. During usage, the electronic device is detected by the slow detection. Slow detection is used to obtain an accurate detection result and adjust the scheme, thereby improving the robustness of the microphone state.

During the slow detection, the energy of a signal collected by each signal channel is calculated. If a minimum value among the energy of all the signal channels is greater than a set threshold, correlation detection is performed. In order to obtain a more robust detection result, detection may be performed multiple times to obtain a final detection result. For example, a time period of the slow detection time is set to be 2 seconds, the detection result is determined only when results of three slow detections of the microphone are identical, and the microphone state or the sound pickup algorithm is adjusted according to the detection result.

In addition, because the correlation detection is limited to be the relationship between multiple signal channels, false detection still exists. Therefore, a reference sound is also used for detection here. The reference sound is an audio signal output of the electronic device in the above embodiment. Based on the reference sound, an echo signal component corresponding to the audio signal output is filtered out to obtain a target signal. If the signal channel is abnormal, the filtering cannot be performed normally. Therefore, each signal channel can be detected according to this principle.

Figure 6:
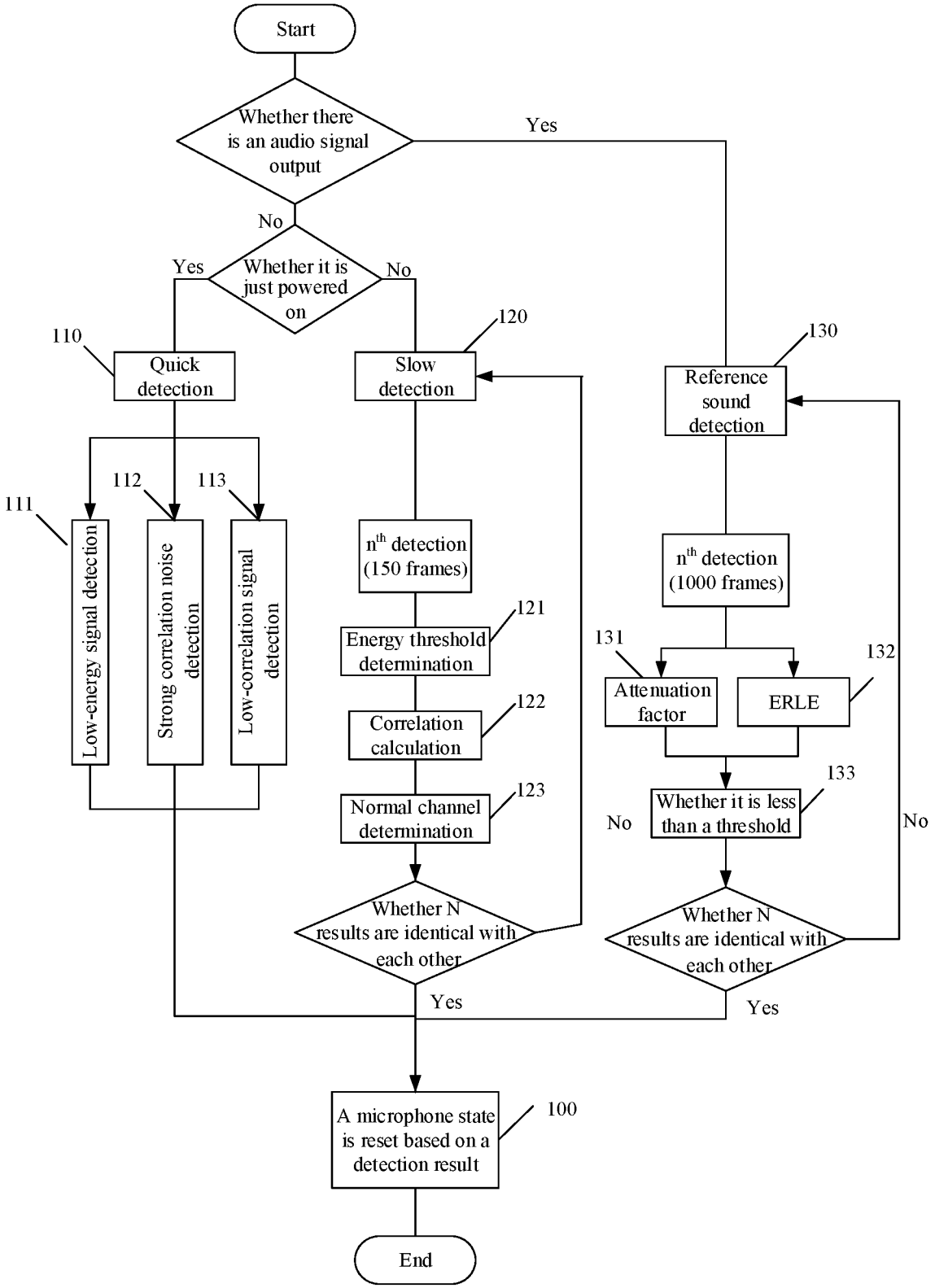
FIG. 6 is a sixth flowchart of a method for detecting an audio input module according to some embodiments of the present disclosure.

As shown in FIG. 6, the quick detection 110 is used to obtain a result once the device is powered on. However, because data is less and the time is short in the quick detection, the obtained data is often unreliable. Therefore, the quick detection is used to detect only a state of a microphone with serious fault, and a higher threshold is set.

(1) Energy detection: if the energy of a channel is less than the set threshold during detection, it indicates that the channel has not received a valid voice signal. As shown in FIG. 6, low-energy signal detection 111 is performed to determine a signal channel of which a signal energy value is less than the threshold.

(2) Correlation detection 1: the correlation between every two of the channel signals is detected. As long as the correlation between a pair of microphone signals is greater than a threshold, it indicates that the pair of microphones is normal.

(3) Correlation detection 2: the correlation between every two of the channel signals is detected, the correlations of each microphone are summed, and the sum is compared with a threshold. If the sum is higher than the threshold, it indicates that the microphone is normal.

The above correlation detection includes strong correlation noise detection 112 and low correlation signal detection 113 in FIG. 6. The strong correlation noise detection 112 is to determine signal channels between which the correlation is higher than a threshold range. For example, when the signals received by the two signal channels are almost identical, a short circuit may occur. The low-correlation signal detection 113 is to screen out a signal channel that has poor correlation with other signal channels. These signal channels may be abnormal and the received signal is distorted.

After the above quick detection is completed, a detection result is obtained. The microphone state 100 may be reset according to the detection result, and an appropriate algorithm may be called, to enable the microphone to be used normally, thereby reducing the interference of the damaged channel on the overall sound pickup effect of the microphone as much as possible.

For the slow detection 120, the slow detection needs to provide stable and accurate determination in order to minimize misjudgments. The number of slow detections may be adjusted, such as 3 and 5, and the frame length of slow detection may also be adjusted, such as 150 frames, 200 frames and 300 frames. One frame here represents a small segment of audio signal. The time of quick detection may also be adjusted, for example, a result is determined within 1 second or 2 seconds.

(1) Energy detection, which is different from that of the quick detection, here, the signal channel of the microphone is screened through energy detection. Only when the energy of each signal channel is greater than a threshold, the correlation detection is performed. As shown in FIG. 6, energy threshold determination 121 is used to screen a signal channel of which the signal energy is greater than the threshold, and the correlation calculation 122 is then performed.

(2) Correlation detection 1: the correlation between every two of the channel signals is detected. As long as the correlation between a pair of microphone signals is greater than the threshold, it indicates that the pair of microphones is normal at this time. The threshold set at this time is lower than the threshold set in the quick detection.

(3) Correlation detection 2: the correlation between every two of the channel signals is detected, the correlations of each microphone are summed and the sum is compared with the threshold. If the sum is higher than the threshold, it indicates that the microphone is normal. The method here is similar to the quick detection method, but a lower threshold may be set.

After the correlation is calculated through the above operations, the normal signal channel 123 is determined. In response to that it is determined that the multiple detection results are identical, the microphone state may be reset 100 based on the detection results, and an appropriate algorithm is called.

When the electronic device has an audio signal output, the above reference sound detection method is used.

Reference sound detection 130 includes the following two aspects.

(1) An attenuation factor 131 is calculated to determine whether the filtering algorithm is stable and convergent, that is, whether the filtering algorithm can filter normally. When the signal channel of the microphone is abnormal, the attenuation factor is small. Therefore, the attenuation factor can be used as a determination basis.

(2) An ERLE 132 is calculated to determine whether the filtering algorithm is stable and convergent, that is, whether the filtering algorithm can be filtered normally. Similarly, if the signal channel of the microphone is abnormal, the ERLE is smaller. Therefore, the ERLE can also be used as a basis for judgment.

(3) Detection logic processing is performed. In some embodiments of the present disclosure, both the attenuation factor and the ERLE described above may be determined. If each of the attenuation factor and the ERLE are less than a predetermined threshold 133, it is considered that the signal channel of the microphone is abnormal. Of course, any one of the above attenuation factor or the ERLE may also be selected as a basis to determine whether the signal channel is abnormal.

In the above method, a multiple joint decision mechanism of energy decision, correlation decision and reference sound detection is introduced to ensure the robustness of a detection system. Therefore, an erroneous detection rate can be effectively reduced, and the user experience of undamaged devices can be ensured. Because the time of the quick detection time is quick, severely damaged devices can be found in time. Meanwhile, the above method has strong robustness and ensures the accuracy of detection results.

Figure 7:
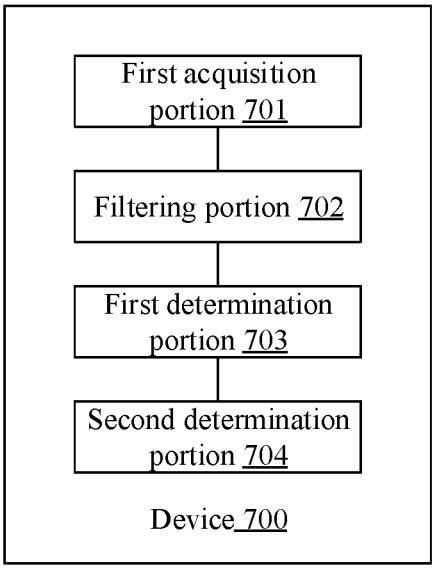
FIG. 7 is a structural block diagram of a device for detecting an audio input module according to some embodiments of the present disclosure.

FIG. 7 is a structural block diagram of a device for detecting an audio input module according to some embodiments of the present disclosure. Referring to FIG. 7, the device 700 includes: a first acquisition portion 701, a filtering portion 702, a first determination portion 703, and a second determination portion 704.

The first acquisition portion 701 is configured to acquire audio input signals received by at least two input signal channels of the audio input module.

The filtering portion 702 is configured to, for each of the audio input signals, filter the audio input signal according to a preset audio output signal of an electronic device where the audio input module is located, to obtain a target signal.

The first determination portion 703 is configured to, for each of the audio input signals, determine a comparison parameter value according to the target signal and the audio input signal.

The second determination portion 704 is configured to determine a performance state of the audio input module according to the comparison parameter values.

In some embodiments, the filtering module is configured to filter out a signal component corresponding to the audio output signal in the audio input signal, to obtain the target signal.

In some embodiments, the second determination portion includes a first determination subportion and a second determination subportion.

The first determination subportion is configured to determine, in response to that the comparison parameter value is greater than a preset parameter threshold, that the input signal channel corresponding to the audio input signal is a normal channel.

The second determination subportion is configured to determine, in response to that the comparison parameter value is less than or equal to the preset parameter threshold, that the input signal channel corresponding to the audio input signal is a first abnormal channel.

In some embodiments, the device further includes a first disabling portion.

The first disabling portion is configured to disable, if the first abnormal channel exists, the first abnormal channel.

In some embodiments, the comparison parameter value includes an attenuation factor and/or an ERLE.

The attenuation factor includes a ratio of the audio input signal to the target signal.

The ERLE includes a logarithmic value of a square ratio of the audio input signal to the target signal.

In some embodiments, the device further includes a second acquisition portion.

The second acquisition portion is configured to receive signal energy values of audio input signals received by the at least two input signal channels.

The first determination portion is configured to determine, in response to that the signal energy value of the audio input signal is greater than a preset first energy threshold, the comparison parameter value according to the target signal and the audio input signal.

In some embodiments, the device further includes a third determination portion and a second disabling portion.

The third determination portion is configured to determine, in response to the signal energy value of the audio output signal is greater than a preset second energy threshold and the signal energy value of the audio input signal is less than or equal to the first energy threshold, that the input signal channel corresponding to the audio input signal is a second abnormal channel.

The second disabling portion is configured to disable the second abnormal channel.

In some embodiments, the device further includes a fourth determination portion.

The fourth determination portion is configured to determine, according to a correlation between at least two audio input signals, a correlation degree value between the at least two audio input signals.

The second determination portion is configured to determine a performance state of the audio input module according to the correlation degree value and the comparison parameter value.

In some embodiments, the second determination portion includes a third determination subportion, a fourth determination subportion and a fifth determination subportion.

The third determination subportion is configured to determine, in response to that the correlation degree value of the at least two audio input signals exceeds a range of a preset correlation threshold, that a corresponding input signal channel is a third abnormal channel.

The fourth determination subportion is configured to determine, in response to that the correlation degree value of the at least two audio input signals is within the range of the preset correlation threshold, a performance state of the input signal channel according to the comparison parameter value.

The fifth determination subportion is configured to determine the performance state of the audio input module according to the performance states of all of the input signal channels of the audio input module.

In some embodiments, the device further includes a third disabling portion.

The third disabling portion is configured to disable, if the third abnormal channel exists, the third abnormal channel.

With regard to the device in the above embodiments, the specific manners in which the respective modules perform the operations have been described in detail in the method embodiment, and will not be explained in detail herein.

Figure 8:
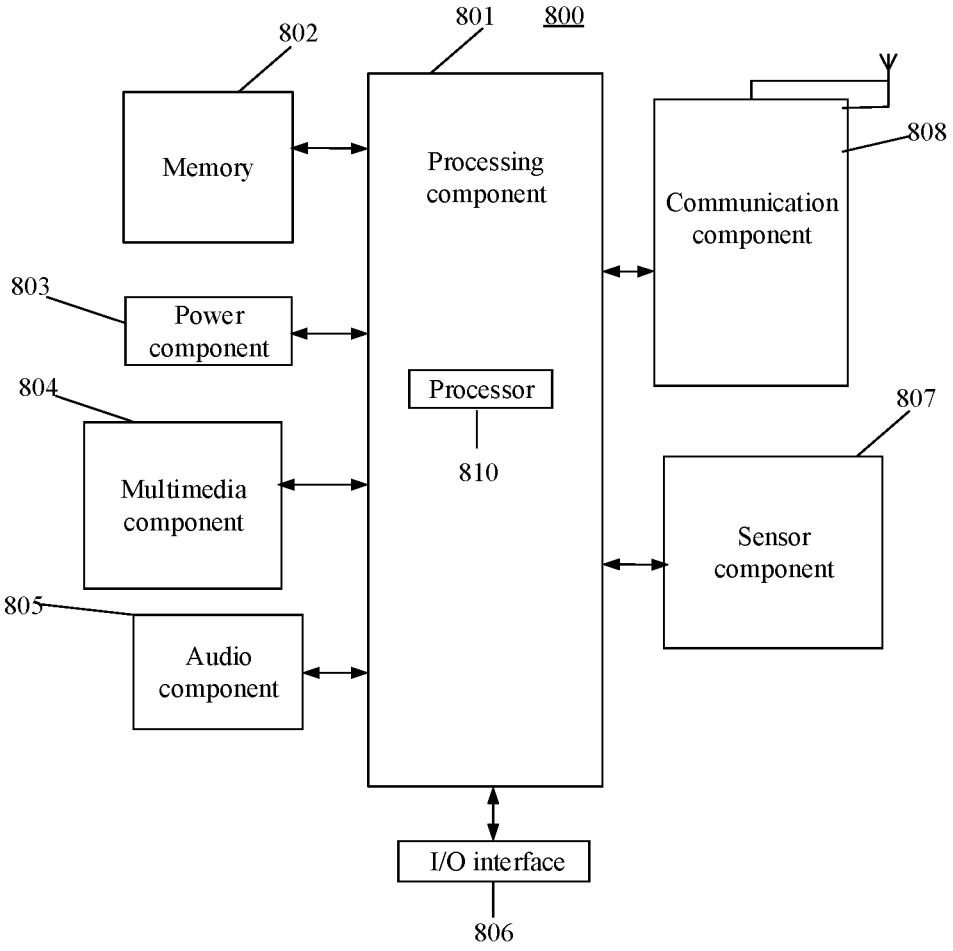
FIG. 8 is a structure block diagram of an electronic device according to some embodiments of the present disclosure.

FIG. 8 is a structure block diagram of an electronic device 800 according to some embodiments of the present disclosure. For example, the electronic device 800 may be a mobile phone, a computer, a digital broadcasting terminal, a messaging device, a gaming console, a tablet, a medical device, exercise equipment, a personal digital assistant and the like.

Referring to FIG. 8, the electronic device 800 may include one or more of the following components: a processing component 801, a memory 802, a power component 803, a multimedia component 804, an audio component 805, an input/output (I/O) interface 806, a sensor component 807 and a communication component 808.

The processing component 801 typically controls overall operations of the electronic device 800, such as the operations associated with display, telephone calls, data communications, camera operations and recording operations. The processing component 801 may include one or more processors 810 to execute instructions to perform all or part of the steps in the above described methods. Moreover, the processing component 801 may further include one or more modules which facilitate the interaction between the processing component 801 and other components. For example, the processing component 801 may include a multimedia module to facilitate the interaction between the multimedia component 804 and the processing component 801.

The memory 810 is configured to store various types of data to support the operation of the electronic device 800. Examples of such data include instructions for any applications or methods operated on the electronic device 800, contact data, phonebook data, messages, pictures, video, etc. The memory 802 may be implemented by any type of volatile or non-volatile memory devices, or a combination thereof, such as an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 803 provides power to various components of the electronic device 800. The power component 803 may include: a power management system, one or more power sources, and any other components associated with the generation, management and distribution of power in the electronic device 800.

The multimedia component 804 includes a screen providing an output interface between the electronic device 800 and the user. In some embodiments, the screen may include a liquid crystal display (LCD) and a touch panel (TP). In some embodiments, organic light-emitting diode (OLED) or other types of displays can be employed. If the screen includes the touch panel, the screen may be implemented as a touch screen to receive input signals from the user. The TP includes one or more touch sensors to sense touches, swipes and gestures on the TP. The touch sensors may not only sense a boundary of a touch or swipe action, but also detect a duration and pressure associated with the touch or swipe action. In some embodiments, the multimedia component 804 includes a front camera and/or a rear camera. The front camera and/or the rear camera may receive external multimedia data when the electronic device 800 is in an operation mode, such as a photographing mode or a video mode. Each of the front camera and/or the rear camera may be a fixed optical lens system or have focusing and optical zooming capabilities.

The audio component 805 is configured to output and/or input audio signals. For example, the audio component 805 includes a microphone (MIC) configured to receive an external audio signal when the electronic device 800 is in an operation mode, such as a call mode, a recording mode, and a voice recognition mode. The received audio signal may be further stored in the memory 810 or transmitted via the communication component 808. In some embodiments, the audio component 805 further includes a speaker to output audio signals.

The I/O interface 806 provides an interface between the processing component 801 and peripheral interface modules, such as a keyboard, a click wheel, buttons, and the like. The buttons may include, but be not limited to, a home button, a volume button, a starting button, and a locking button.

The sensor component 807 includes one or more sensors configured to provide state assessments of various aspects of the electronic device 800. For example, the sensor component 807 may detect an open/closed state of the electronic device 800, relative positioning of components, e.g., the display and the keypad, of the electronic device 800. The sensor component 807 may also detect a change in position of the electronic device 800 or a component of the electronic device 800, presence or absence of user contact with the electronic device 800, an orientation or an acceleration/deceleration of the electronic device 800, and a change in temperature of the electronic device 800. The sensor component 807 may include a proximity sensor configured to detect presence of a nearby object without any physical contact. The sensor component 807 may also include a light sensor, such as a complementary metal oxide semiconductor (CMOS) or charge coupled device (CCD) image sensor, configured for use in an imaging application. In some embodiments, the sensor component 807 may also include an acceleration sensor, a gyroscope sensor, a magnetic sensor, a pressure sensor or a temperature sensor.

The communication component 808 is configured to facilitate wired or wireless communication between the electronic device 800 and other electronic devices. The electronic device 800 may access a wireless network based on a communication standard, such as Wi-Fi, 2G, 3G, 4G, or 5G, or a combination thereof. In some embodiments of the present disclosure, the communication component 808 receives a broadcast signal or broadcast associated information from an external broadcast management system via a broadcast channel. In some embodiments of the present disclosure, the communication component 808 further includes a Near Field Communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the electronic device 800 may be implemented by one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, a non-transitory computer readable storage medium including instructions is further provided, such as the memory 802 including instructions. The instructions may be executable by the processor 810 in the electronic device 800, for performing the above-described methods. For example, the non-transitory computer-readable storage medium may be a ROM, a CD-ROM, a magnetic tape, a floppy disc, an optical data storage device and the like.

A non-transitory computer-readable storage medium is provided. The instructions in the storage medium, when being executed by a processor of a mobile terminal, enable the mobile terminal to perform any one method provided in the above embodiments.

The various device components, modules, circuits, units, blocks, or portions may have modular configurations, or are composed of discrete components, but nonetheless can be referred to as "modules" or "portions" in general. In other words, the "components," "modules," "blocks," "portions," or "units" referred to herein may or may not be in modular forms, and these phrases may be interchangeably used.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A method for detecting an audio input, comprising:

acquiring audio input signals received by at least two input signal channels of an audio input module;

for each of the audio input signals, filtering the audio input signal according to a preset audio output signal of an electronic device where the audio input module is located, to obtain a target signal;

for each of the audio input signals, determining a comparison parameter value according to the target signal and the audio input signal, wherein the comparison parameter value comprises at least one of an attenuation factor or an echo return loss enhancement (ERLE); the attenuation factor comprises a ratio of the audio input signal to the target signal; and the ERLE comprises a logarithmic value of a square ratio of the audio input signal to the target signal; and determining a performance state of the audio input module according to the comparison parameter values.

2. The method according to claim 1, wherein the filtering the audio input signal according to the audio output signal of the electronic device where the audio input module is located to obtain the target signal comprises:

filtering out a signal component, corresponding to the audio output signal, in the audio input signal to obtain the target signal.

3. The method according to claim 1, wherein the determining the performance state of the audio input module according to the comparison parameter values comprises: for each of the comparison parameter values, in response to that the comparison parameter value is greater than a preset parameter threshold, determining that the input signal channel corresponding to the audio input signal is a normal channel; and in response to that the comparison parameter value is less than or equal to the preset parameter threshold, determining that the input signal channel corresponding to the audio input signal is a first abnormal channel.

4. The method according to claim 3, further comprising:

in response to there is the first abnormal channel, disabling the first abnormal channel.

5. The method according to claim 1, further comprising:

receiving signal energy values of the audio input signals received by the at least two input signal channels, wherein determining the comparison parameter value according to the target signal and the audio input signal comprises:

determining the comparison parameter value according to the target signal and the audio input signal in response to that the signal energy value of the audio input signal is greater than a preset first energy threshold.

6. The method according to claim 5, further comprising:

determining that the input signal channel corresponding to the audio input signal is a second abnormal channel in response to that the signal energy value of the audio output signal is greater than a preset second energy threshold and the signal energy value of the audio input signal is less than or equal to the first energy threshold; and disabling the second abnormal channel.

7. The method according to claim 1, further comprising:

determining, according to a correlation between at least two audio input signals, a correlation degree value between the at least two audio input signals, wherein determining the performance state of the audio input module according to the comparison parameter value comprises:

determining the performance state of the audio input module according to the correlation degree value and the comparison parameter value.

8. The method according to claim 7, wherein the determining the performance state of the audio input module according to the correlation degree value and the comparison parameter value comprises:

determining that the input signal channel is a third abnormal channel, in response to that the correlation degree value of the at least two audio input signals exceeds a range of a preset correlation threshold;

determining the performance state of the input signal channel according to the comparison parameter value in response to that the correlation degree value of the at least two audio input signals is within the range of the preset correlation threshold; and determining the performance state of the audio input module according to the performance state of each input signal channel of the audio input module.

9. The method according to claim 8, further comprising:

disabling the third abnormal channel in response to that there is the third abnormal channel.

10. An electronic device implementing the method of claim 1, comprising the audio input module, wherein the electronic device is configured to:

based on the comparison parameter value determined in the filtering of the audio output signal from the audio signal, determine whether an input signal channel filters out the audio output signal normally, and further determine the performance state of the audio input module;

detect an abnormal input signal channel; and adjust a data processing algorithm of the audio input module for each input signal channel based on the input signal channel detected, thereby improving accuracy and robustness of the audio input module.

11. A device for detecting an audio input, comprising:

a processor; and memory for storing instructions executable by the processor, wherein the processor is configured to execute the instructions to:

acquire audio input signals received by at least two input signal channels of an audio input module;

for each of the audio input signals, filter the audio input signal according to a preset audio output signal of an electronic device where the audio input module is located, to obtain a target signal;

for each of the audio input signals, determine a comparison parameter value according to the target signal and the audio input signal, wherein the comparison parameter value comprises at least one of an attenuation factor or an echo return loss enhancement (ERLE); the attenuation factor comprises a ratio of the audio input signal to the target signal; and the ERLE comprises a logarithmic value of a square ratio of the audio input signal to the target signal; and determine a performance state of the audio input module according to the comparison parameter values.

12. The device according to claim 11, wherein the processor is further configured to execute the instructions to:

filter out a signal component, corresponding to the audio output signal, in the audio input signal to obtain the target signal.

13. The device according to claim 11, wherein the processor is further configured to execute the instructions to:

in response to that the comparison parameter value is greater than a preset parameter threshold, determine that the input signal channel corresponding to the audio input signal is a normal channel; and in response to that the comparison parameter value is less than or equal to the preset parameter threshold, determine that the input signal channel corresponding to the audio input signal is a first abnormal channel.

14. The device according to claim 13, wherein the processor is further configured to execute the instructions to:

in response to there is the first abnormal channel, disable the first abnormal channel.

15. The device according to claim 11, wherein the processor is further configured to execute the instructions to:

acquire signal energy values of the audio input signals received by the at least two input signal channels, wherein the processor is configured to run the executable instructions to:

determine the comparison parameter value according to the target signal and the audio input signal in response to that the signal energy value of the audio input signal is greater than a preset first energy threshold.

16. The device according to claim 15, wherein the processor is further configured to execute the instructions to:

determine that the input signal channel corresponding to the audio input signal is a second abnormal channel in response to that the signal energy value of the audio output signal is greater than a preset second energy threshold and the signal energy value of the audio input signal is less than or equal to the first energy threshold; and disable the second abnormal channel.

17. The device according to claim 11, wherein the processor is further configured to execute the instructions to:

determine, according to a correlation between at least two audio input signals, a correlation degree value between the at least two audio input signals;

determine the performance state of the audio input module according to the correlation degree value and the comparison parameter value;

determine that the input signal channel is a third abnormal channel, in response to that the correlation degree value of the at least two audio input signals exceeds a range of a preset correlation threshold;

determine the performance state of the input signal channel according to the comparison parameter value in response to that the correlation degree value of the at least two audio input signals is within the range of the preset correlation threshold;

determine the performance state of the audio input module according to the performance state of each input signal channel of the audio input module; and disable the third abnormal channel in response to that there is the third abnormal channel.

18. A non-transitory computer-readable storage medium having stored therein computer-executable instructions that, when being executed by a processor, implement operations of:

acquiring audio input signals received by at least two input signal channels of the audio input module;

for each of the audio input signals, filtering the audio input signal according to a preset audio output signal of an electronic device where the audio input module is located, to obtain a target signal;

for each of the audio input signals, determining a comparison parameter value according to the target signal and the audio input signal, wherein the comparison parameter value comprises at least one of an attenuation factor or an echo return loss enhancement (ERLE); the attenuation factor comprises a ratio of the audio input signal to the target signal; and the ERLE comprises a logarithmic value of a square ratio of the audio input signal to the target signal; and determining a performance state of the audio input module according to the comparison parameter values.

* * * * *